United States Patent [19]

Kingery et al.

[11] Patent Number: 4,815,385

[45] Date of Patent: Mar. 28, 1989

[54] BLAST FOCUSING METHOD AND APPARATUS

[75] Inventors: Charles N. Kingery, Aberden; John D. Sullivan, Jr., Edgewood, both of Md.

[73] Assignee: The United States of America as represented by the Secretary of the Army, Washington, D.C.

[21] Appl. No.: 133,849

[22] Filed: Dec. 16, 1987

[51] Int. Cl.[4] ..... F42B 3/00

[52] U.S. Cl. ..... 102/320; 102/305; 102/312; 102/313

[58] Field of Search ..... 102/305, 312, 313, 320

[56] References Cited

U.S. PATENT DOCUMENTS

| | | | |
|---|---|---|---|
| H162 | 11/1986 | Sullivan, Jr. et al. | 102/403 |
| 2,925,038 | 2/1960 | Walker | 102/23 |
| 3,136,251 | 6/1964 | Witow | 102/67 |
| 3,598,051 | 8/1971 | Avery | 102/23 |
| 3,654,866 | 4/1972 | Fritz | 102/23 |
| 3,720,166 | 3/1973 | Sewell et al. | 102/22 |
| 4,160,412 | 7/1979 | Snyer et al. | 102/29 HC |
| 4,273,048 | 6/1981 | Aley et al. | 102/363 |
| 4,357,873 | 11/1982 | Jager | 102/310 |
| 4,513,665 | 4/1985 | Ricketts et al. | 102/312 X |

OTHER PUBLICATIONS

John Hopkins University Applied Physics Laboratory Memo MM-2-092, "Focused Blast and Focused Blast/-Fragment Warhead Firing Tests—Preliminary Report", dated Jun. 17, 1966.

John Hopkins University Applied Physics Laboratory Memo MM-2-110, "Focused Blast and Focused Blast/-Fragment Warhead Firing Tests—Interim Report", dated Mar. 27, 1967.

U.S. Army Ballistic Research Laboratory Memorandum Report BRL-MR-3539, "Enhanced Blast as a Function of Multiple Detonations and Shape for Bare Pentolite Charges", by Kingery and Coulter, dated Jul. 1986.

*Primary Examiner*—Peter A. Nelson

*Attorney, Agent, or Firm*—Saul Elbaum; Thomas E. McDonald; Muzio B. Roberto

[57] ABSTRACT

A blast focusing technique for producing high pressure on a ground plane, in which a right circular cylinder of explosive material is positioned adjacent the ground plane with the cylinder axis orthogonal to the ground plane. The cylinder is simultaneously detonated at both ends by detonators disposed on the cylinder axis at each end of the cylinder.

9 Claims, 3 Drawing Sheets

BLAST FOCUSING METHOD AND APPARATUS

RIGHTS OF THE GOVERNMENT

The invention described herein may be manufactured, used and licensed by and for the United States Government for governmental purposes without payment to us of any royalties thereon.

BACKGROUND OF THE INVENTION

1. Field of the Invention

The invention relates generally to blast focusing methods and apparatus, and, more particularly, to blast focusing methods and apparatus for terrain clearance, especially clearance of mine fields containing hard-to-kill land mines.

2. Description of the Prior Art

Explosive devices are normally initiated by one detonator, also called a blasting cap, which is sometimes augmented by a booster. The design of detonators and explosives is aimed at very dependable, non-accidental firing. There is nothing special about standard explosives in regard to tailoring their destructiveness. Blast destructiveness depends on the explosive's mass and distance to the target. With the explosive's energy released as a shock wave in all directions, mostly non-target directions, much of the energy is wasted. Thus, the explosive must land fairly close to the target.

Some explosive devices, generally called blast focusing warheads, include various means to redistribute an explosives mass's energy. The object of most blast focusing devices is to direct the blast in order to propel fragments to extra-high velocity at a target. Two well known examples of blast focusing devices are the spherical or conical shaped charge and the linear shaped charge, which are designed respectively for metal penetration and metal cutting. The focusing action is due to the explosive shape and the standoff distance.

U.S. Pat. No. 3,136,251 issued June 9, 1964 to Witow, describes a directional warhead in which the blast is directed by plates within the explosive that are charged negatively in the direction of the target as sensed by a proximity device. The explosive casing is positively charged. When detonated, positive ions move to the internal plate while free electrons move to the inner surface of the case and act as a shock absorber. For a instant of time, the case will fragment first and blast flow is increased in the negative plate direction.

U.S. Pat. No. 3,598,051, issued Aug. 10, 1971 to Avery, discloses a spherical charge with twelve symmetrically placed detonators that are fired in pairs, some at once and others equally delayed in order to create detonation waves that would collide constructively along one of nine possible firing axes. Electronic sensing and switching will fire the warhead along the axis pointing at the desired target.

In another known directional warhead, the blast is focused by explosively indenting a cased explosive. An instant later, the main charge is initiated and the blast favors the indentation location, which is electronically set in a target's direction.

In Lab Memos MM-2-092, dated June 17, 1966, and MM-2-110, dated Mar. 27, 1967, of the Applied Physics Laboratory, John Hopkins' University, tests were reported by Ferrenz, Donnelly, and Robertson on a focused blast warhead in which the explosive charge had an unusual spool shape, with a hollow core, that was detonated simultaneously at each end through wave shaping devices.

U.S. Pat. No. 4,273,048 issued June 16, 1981 to Aley et al, describes a fuel-air explosive weapon launched from a remote distance for clearing minefields. During flight, a parachute at the back of the round is deployed to slow the round and align it vertically. Thereafter, a compacted probe at the front of the round is extended. When this probe makes contact with the ground, it initiates deployment of two firing cloud detonators and thereafter initiates a burster charge which disperses a fuel-air cloud over a section of the minefield. Detonation of this cloud by the cloud detonators produces high pressure under the cloud which causes triggering of the mines.

Some hard-to-kill land mines can only be explosively detonated by very high blast pressure. While fuel-air explosive warheads produce high pressure over a large ground area when detonated, these warheads generally do not produce the very high peak pressures required to detonate these hard-to-kill mines. These very high pressures can be produced by unfocused solid explosive warheads; however, the area of the ground plane subject to these very high pressures is low relative to the quantity of solid explosive detonated.

SUMMARY OF THE INVENTION

Therefore, it is a object of the invention to provide a method and apparatus for providing a blast region which affects hard-to-kill land mines.

It is another object of the invention to provide a blast focusing technique and apparatus for producing high pressure in a larger area on the ground than can an equal weight of explosives without the focusing technique.

It is a further object of the invention to increase the blast capability and reliability of existing and new designs of bombs and high angle of fall missile warheads. It is a related object of the invention to provide a blast focusing technique and apparatus for increasing the effectiveness of area demolition devices that ruin buildings or blast forests for helicopter landing zones.

In the preferred blast focusing technique, according to the invention, a right circular cylinder of explosive material is disposed adjacent the surface of the minefield to be cleared so that the cylinder axis is essentially orthognal to the ground surface. The explosive material of the cylinder is detonated, with the detonation being initiated on the cylinder axis at the opposite ends of the cylinder at approximately the same time. The use of such a dual detonated explosive cylinder not only enhances blast in the collision or focusing plane of the cylinder midway between its two ends but also increases blast on the ground below this collision plane. In particular, the area of the ground surface subjected to the very high pressures (7,000 kPa or more) necessary to cause terminal effects to hard targets such as hard-to-kill land mines, is much larger than the ground area subjected to such high pressures caused by either an unfocused explosive device or a fuel-air explosive device.

Such a right circular cylinder of explosive material can be incorporated in an aerial bomb, artillery projectile, or self-propelled missile, such as that described in the above-referenced U.S. Pat. No. 4,273,048 to Aley et al incorporated herein by reference, to allow remote clearing of a minefield by such a projectile. This projectile must include an attitude adjustment mechanism such as a drogue parachute or guidance vanes to adjust the attitude of the explosive cylinder during flight of the projectile so that the cylinder axis is essentially vertical as the projectile approaches the surface of the ground. Also, this projectile must include a sensor, such as an extendable probe, for activating the detonators at opposite ends of the explosive cylinder when the cylinder is disposed a predetermined distance from the ground surface.

BRIEF DESCRIPTION OF THE DRAWINGS

The invention will be understood, and further objects, features and advantages thereof will become more apparent from the following description of the preferred embodiment, taken in conjunction with the accompanying drawings in which.

DESCRIPTION OF THE PREFERRED EMBODIMENTS

Figure 1:
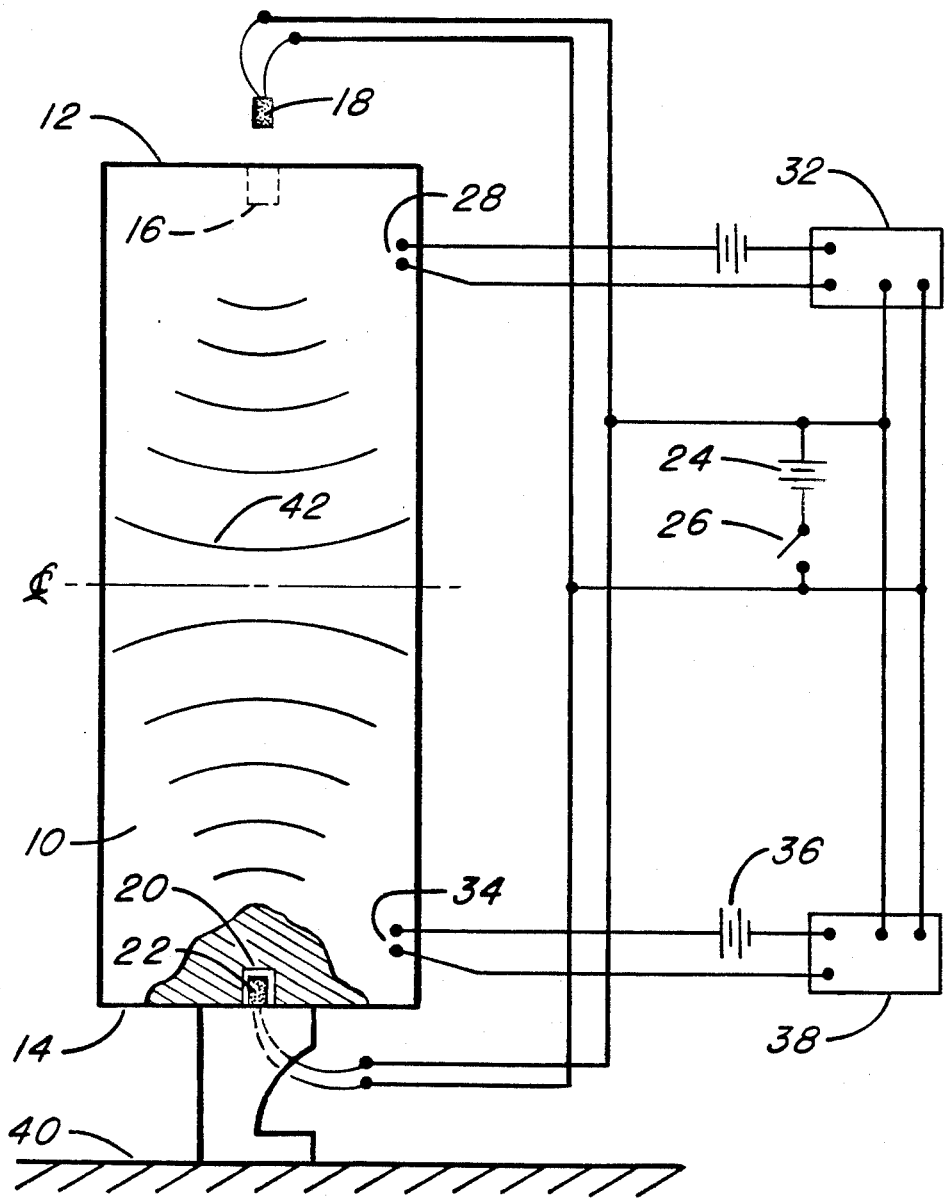
FIG. 1 is a schematic diagram of the preferred embodiment of the invention, which utilizes a dual-detonated cylindrical explosive element.

The preferred embodiment invention shown in FIG. 1 includes a right circular cylinder 10 of cast explosive having an axis of symmetry 0–0' extending between opposite ends 12, 14 of the cylinder 10. The top end 12 of the cylinder 10 includes a shallow well 16 disposed on the axis 0–0' containing a detonator 18. Likewise, the bottom 14 of the cylinder 10 includes another shallow well 20 disposed on the axis 0–0' and containing another detonator 22. The detonators 18, 22 are connected in parallel to a DC power supply 24 through a switch 26.

FIG. 1 also shows a test circuit for monitoring the functioning of the explosive cylinder 10. This test circuit includes a first ionization probe 28 which is attached to the side of the cylinder 10 near the top cylinder end 12 and which is connected through a DC power supply 30 to a counter or timer 32. This test circuit also includes a second ionization probe 34 which is attached to the side of the cylinder near the bottom cylinder end 14 and which is connected through another DC power supply 36 to a second counter or timer 38. The two timers 32, 38 are also connected to the DC power supply 24 through the switch 28 so that operation of these timers 32, 38 commences when the switch 26 is closed.

In the method according to the invention, the cylinder 10 of cast explosive is disposed adjacent a ground plane 40 with the cylinder axis 0–0' being essentially orthogonal to the ground plane 40. When the switch 26 is closed, detonation is initiated essentially simultaneously at the opposite ends 12, 14 of the cylinder 10. The collision of detonation waves 42, started simultaneously at the opposite ends 12, 14 of the cylinder 10, forces the gas products into a pancake shape. The shock wave, formed from the violent expansion of gas products, moves in an expanding annulus over the ground plane 40. The redirection of energy release puts higher pressure on the ground plane 40 than would be put on this ground plane by the detonation of an equivalent unfocused charge.

In the preferred embodiment of the invention tested by Applicants, the structural explosive of the cylinder 10 is cast Pentolite (50 PETN/50 TNT). The cylinder 10 has an aspect ratio of length to diameter of 11'/4' or 2.75, and an average mass of 3.729 kg. The invention is not restricted to this explosive or aspect ratio, but generally, the aspect ratio will fall within the range of one to six.

The purpose of the wells 16, 20 is to locate the axis 0–0' and to keep the ends and sides of the detonators 18, 22 in contact with the explosive structure. Tape can be used to keep the detonators 18, 22 from slipping out of the wells 16, 20. In this embodiment, the size of the wells 16, 20 was 0.31 inches diameter by 0.50 inches depth, slightly over the size of the detonator 18 or 22.

Preferably, the detonators 18, 22 are static resistant, low voltage detonators holding seven grains of explosive, similar to Atlantic Research Corporation's No. 2023 detonator. The advantages of this type of detonator are: (1) This detonator will initiate Pentolite, a moderately sensitive explosive, without a booster; (2) This detonator does not require a special power supply in considerations of firing line type and distance away, as do explosive bridge wire detonators; and (3) They are smaller and safer than engineer special detonators. The chief disadvantage of this type of detonator is that its lead wires are bare, so that one wire must be taped to prevent an accidental short circuit or misfire. The invention is not confined to these detonators. The only rigid requirement for focusing is that detonators fire simultaneously, or at most only a few microseconds apart.

Simultaniety in the firing of the two detonators results from two features of the invention: (1) sending moderately high voltage to the low voltage detonators 18, 22; and (2) utilizing a parallel hookup between the two detonators and 18, 22 and the 140 volt power supply 24. In field tests, a single voltage-current pulse is sent through conventional firing lines, i.e. heavy duty two conductor cable, to a transfer box. At the box, where the change to a replaceable firing line section is made, two equal lengths of No. 22 gage twisted pair conductors are run to the firing pad. Each replaceable line is spliced to a detonator 18 or 22, which enables each detonator to get the firing pulse at the same time. By moderately exceeding the six volts needed to fire the detonators 18, 22, simultaneity is closely approached. A 140 volt decaying pulse will result in a firing time time difference of at most one to five microseconds. High voltage (1000 volt) would give an unnecessary improvement in simultaneity and would introduce equipment complications.

Functioning of the explosive is monitored by the ionization probes 28, 34 taped to the side of the explosive cylinder 10. The probes prove workability of the invention but are no part of the invention itself. Each ionization probe 28, 34 is merely the separated, bared ends of a twisted pair wire that carries the current back to its associated timer 32, 38 when the explosion initiated by the detonator 18 or 22 momentarily forms a current path. The probes discriminate between an explosion caused by one detonator firing alone and a focusing blast resulting from the detonators firing together. Each probe 28, 34 is taped to the cylinder 10 about one inch from a cylinder end or nine inches apart. Since a detonation wave in high explosive travels at a rate of one fourth inch per microsecond, or seven millimeters per microsecond, a lapse time of about 38 microseconds is expected if the device initiated only at only one end instead of simultaneously at both ends. In the monitoring circuit shown in FIG. 2, the two timers 32, 38 are started off the firing pulse from the power supply 24, and each timer stops counting when its ionization probe switches on by the passage of the detonation wave. In a successful double detonation of the cylinder 10, each counter will typically read about 30 microseconds, the time from Fire to the detonation wave reaching a probe, and more importantly, the counters will disagree by no more than plus or minus five microseconds. Since the disagreement is well below the 38 microseconds expected by only a single detonator firing, this monitoring circuit accurately detects the occurrence or nonoccurrence of double detonation.

Figure 2:
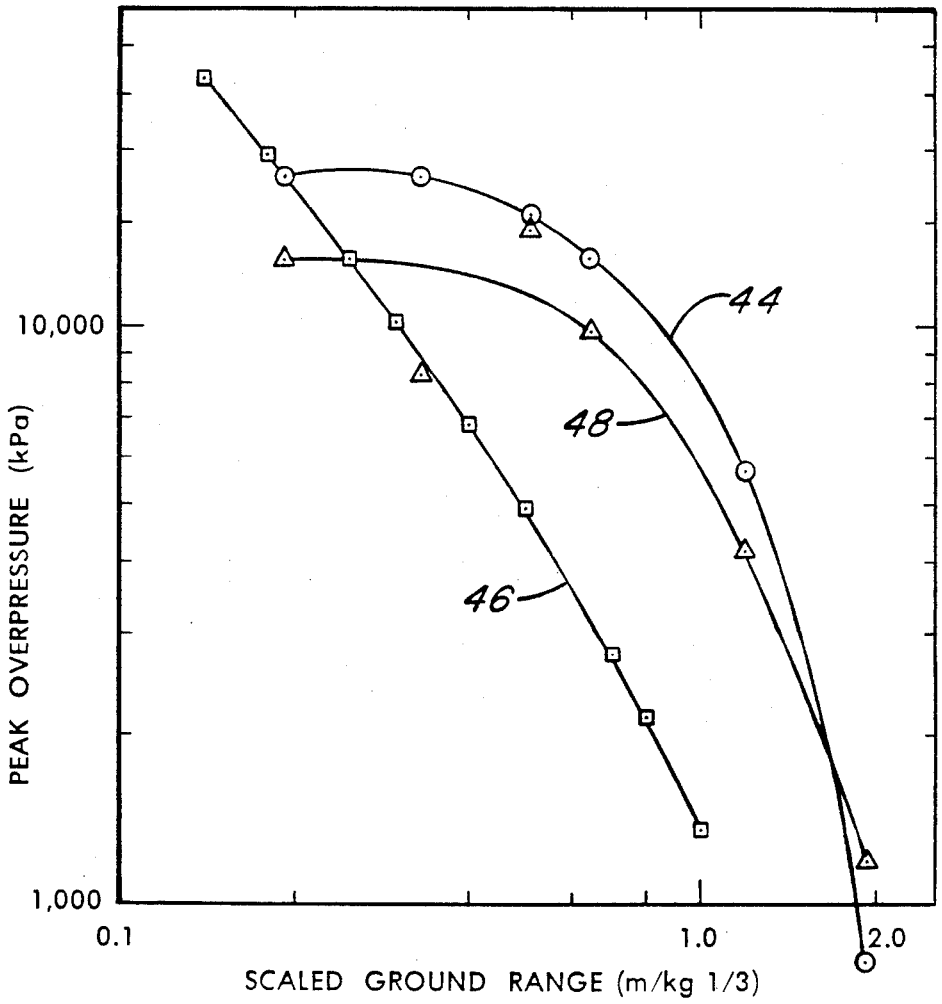
FIG. 2 is a graph of pressure versus distance, showing the peak pressure exerted on the ground by the embodiment shown in FIG. 1 and also by an equivalent hemispherical explosive element detonated in the center of the flat side.

The results of field tests performed on the preferred embodiment of FIG. 1 are shown graphically in FIG. 2. Curve 44 indicates the peak overpressure in kilopascals (kPa) exerted on the ground plane versus distance along the ground plane from the explosive cylinder axis 0–0' when the lower end 14 of the cylinder 10 is placed directly on the ground plane (sand) and the cylinder 10 is detonated essentially simultaneously at its opposite ends 12, 14. This distance is given as a scaled ground range, that is, as meters per the cube root of the explosive mass in kilograms. Thus, for the preferred embodiment described above, which has a mass of approximately 3.729 kg, the actual ground range would be 1.551 times the scaled ground range shown in FIG. 2.

Curve 46 of FIG. 2 shows the peak overpressure exerted on the ground plane by a TNT hemisphere of equal weight to that of the preferred embodiment, in which the flat side of the hemisphere is placed on the ground plane 40 and hemisphere is detonated by a detonator in the center of the flat side. Analysis of the two curves 44, 46 gives the pressure in the 7000–14000 kPa band from 1 kg of the preferred embodiment as equivalent to the pressure arising from 23 kg of a TNT hemisphere on the ground. The equivalence of Pentolite to TNT is just 1.17, which shows that the shape and dual detonation of the prefered embodiment and not the explosive material is acting the cause of this large equivalence.

The explosive cylinder 10 does not need to be placed on the ground plane in order to exert a very high pressure, in the order of 7000–14000 kPa, on a large area of the ground plane. For example, curve 48 of FIG. 2 shows the results of a test made on the preferred embodiment with the lower end of the cylinder 10 disposed approximately 6 inches above the ground plane. Field tests were also made to compare the preferred embodiment described above with a fuel-air explosive (FAE) warhead. Generally, the peak overpressures recorded on the ground surface for these FAE warheads were in the range of 2800 to 4200 kPa. The warheads used for this comparison had a payload of 32.6 kg of ethylene oxide. They were tested at a height of blast (HOB) of 1.47 meters or a scaled HOB of 0.46 m/kg$^{\frac{1}{3}}$. HOB is not critical to FAE as long as the warhead HOB is over 0.2 m/kg$^{\frac{1}{3}}$ and the cloud bottom is still on the ground. These and other field tests were described by the inventors in a memorandum report BRL MR-3549, entitled "Blast Enhancement from Dual Detonation", which can be obtained from the Director, U.S. Army Ballistic Research Laboratory, Aberdeen Proving Ground, Md. 21005-5066.

Figure 3:
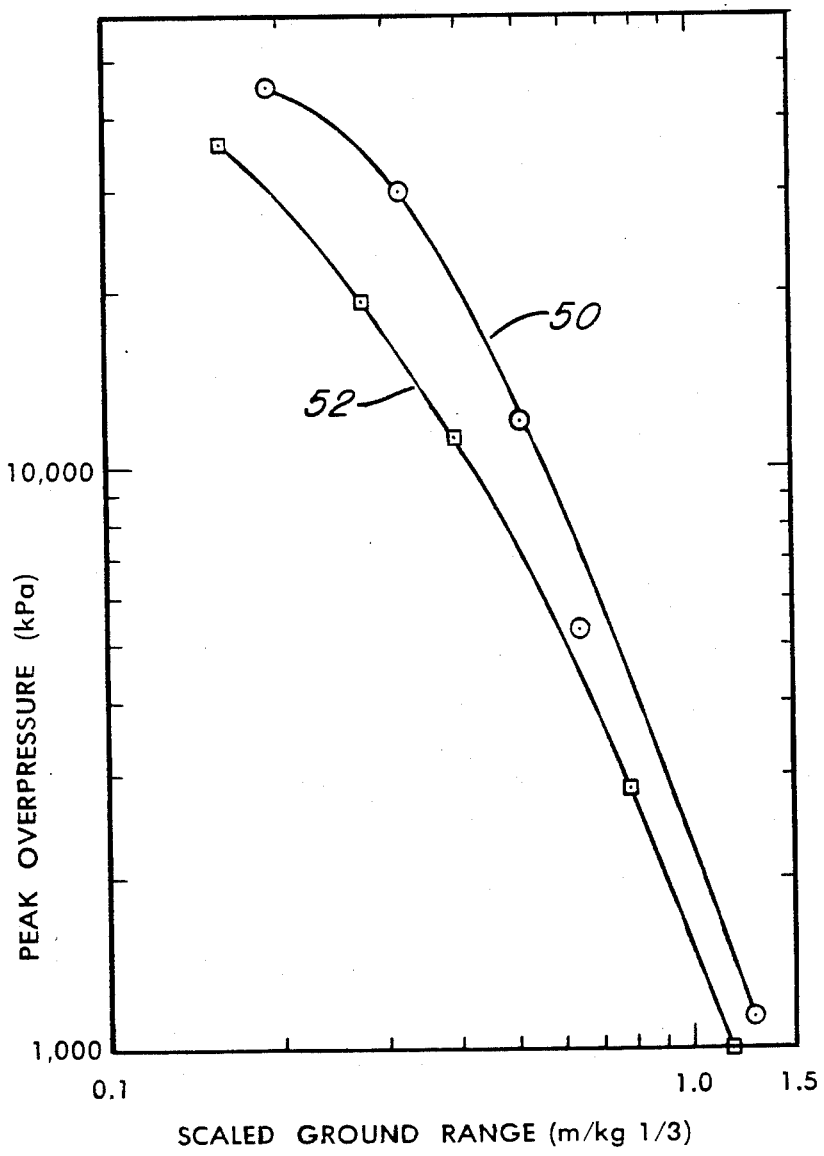
FIG. 3 is a graph of pressure versus distance showing the peak pressure exerted on the ground by a spherical explosive element with bipolar detonation and a similar spherical charge with central detonation.

In the preferred embodiment of the invention, a right circular cylinder of explosive material is used. However, other shapes of explosives can be used, so long as the explosive is dual detonated to produce a blast focusing plane which extends above and parallel to the ground plane on which high pressure is to be exerted. This is illustrated by FIG. 3, which is a plot of over pressure versus scaled distances for a spherical charge with simultaneous polar detonations (curve 50) and for a standard spherical charge with central detonation (curve 52). The values for curve 50 was established from a 3.835 kg spherical charge of Pentolite which was detonating at an HOB of 0.61 meters, or a scaled HOB for a 1 kg charge of 0.20 m/kg$^{\frac{1}{3}}$. The values for curve 52 was established from a 454 kg spherical charge of TNT which was centrally detonated at a scaled HOB of 0.21 m/kg$^{\frac{1}{3}}$. From these curves, it is seen that the area of the ground plane subjected to an overpressure of at least 7000 kPa is about 50 percent greater than that of the spherical charge with central detonation.

As discussed above, a dual-detonated explosive charge according to the invention can be delivered to a minefield to be cleared and correctly positioned above the surface of the minefield by various types of warheads, such as an aerial bomb, artillery projectile, or the self-propelled missile described in U.S. Pat. No. 4,273,048 to Aley et al, which is incorporated herein by reference.

Since there are many modifications, variations, and additions to the specific embodiment of the invention described herein which would be obvious to one skilled in the art, it is intended that the scope of the invention be limited only by the appended claims.

What is claimed and desired to be secured by Letters Patent of the United States is:

1. A blast focusing technique for producing high pressure on a ground plane, which comprises the steps of:

disposing an explosive element adjacent the ground plane, the element having an axis of symmetry extending between opposite ends of the element, and the element being disposed so that the element axis of symmetry is essentially orthogonal to the ground plane; and detonating the explosive element, the detonation being initiated on the element axis at the two opposite element ends at approximately the same time.

2. A blast focusing technique, as described in claim 1, wherein the explosive element is a right circular cylinder of explosive material having a diameter and having a length which is greater than the cylinder diameter.

3. A blast focusing technique, as described in claim 2, wherein the ratio of the cylinder length to the cylinder diameter does not exceed 6.

4. A blast focusing technique, as described in claim 2, wherein the cylinder is disposed less than two cylinder lengths from the ground plane when detonation is initiated.

5. A blast focusing technique, as described in claim 1, wherein the explosive element is disposed in a projectile directed along a path of flight to the ground plane and wherein the step of disposing the explosive element further comprises the steps of:

disposing the explosive element during flight so that the element axis is essentially vertical as the projectile approaches the ground plane; and sensing when the explosive element is disposed a predetermined distance from the ground plane at which disposition detonation is initiated.

6. A projectile for producing high pressure on a ground plane to which the projectile is directed along a path of flight, the projectile comprising:

an explosive element having an axis of symmetry extending between opposite ends of the element;

detonation means for initiating detonation of the element on the element axis at the two opposite element ends at approximately the same time;

attitude adjustment means for adjusting the attitude of the explosive element during flight so that the element axis is essentially orthogonal to the ground plane as the projectile approaches the ground plane; and sensing means for activating the detonation means when the explosive element is disposed a predetermined distance from the ground plane.

7. A projectile, as described in claim 6, wherein the explosive element is a right circular cylinder of explosive material.

8. A projectile, as described in claims 7, wherein the ratio of the cylinder length to the cylinder diameter does not exceed 6.

9. A projectile, as described in claim 7, wherein said predetermined distance is less than two cylinder lengths.

* * * * *